US011092334B2

(12) United States Patent
Salu et al.

(10) Patent No.: US 11,092,334 B2
(45) **Date of Patent: *Aug. 17, 2021**

(54) DYNAMIC MULTI-LEGS EJECTOR FOR USE IN EMERGENCY FLARE GAS RECOVERY SYSTEM

(71) Applicant: Saudi Arabian Oil Company, Dhahran (SA)

(72) Inventors: Samusideen Adewale Salu, Ras Tanura (SA); Mohamed A. Soliman, Ras Tanura (SA); Nisar Ahmad K. Ansari, Ras Tanura (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 151 days.

This patent is subject to a terminal disclaimer.

(21) Appl. No.: 16/572,292

(22) Filed: Sep. 16, 2019

(65) Prior Publication Data

US 2020/0011530 A1 Jan. 9, 2020

Related U.S. Application Data

(63) Continuation of application No. 15/810,668, filed on Nov. 13, 2017, now Pat. No. 10,429,067.
(Continued)

(51) Int. Cl.
*F23G 7/08* (2006.01)
*F23K 5/00* (2006.01)
(Continued)

(52) U.S. Cl.
CPC ..... *F23G 7/085* (2013.01); *F23G 5/50* (2013.01); *F23G 7/08* (2013.01); *F23K 5/00* (2013.01);
(Continued)

(58) Field of Classification Search
CPC ... F23G 7/085; F23G 7/08; F23G 5/50; F23K 5/00; F23N 1/002
See application file for complete search history.

(56) References Cited

U.S. PATENT DOCUMENTS 3,932,111 A * 1/1976 Liknes ..... F23G 7/085 431/202
5,195,587 A 3/1993 Webb
(Continued)

FOREIGN PATENT DOCUMENTS

GB 2109930 A 6/1983
GB 2418213 A 3/2006

OTHER PUBLICATIONS

International Search Report and Written Opinion for related PCT application PCT/US2017/063863 dated Feb. 28, 2018.

*Primary Examiner* — David J Laux
*Assistant Examiner* — Nikhil P Mashruwala
(74) *Attorney, Agent, or Firm* — Bracewell LLP; Constance Gall Rhebergen

(57) ABSTRACT

A system and method for recycling flare gas back to a processing facility that selectively employs different numbers of ejector legs depending on the flare gas flowrate. The ejector legs include ejectors piped in parallel, each ejector has a flare gas inlet and a motive fluid inlet. Valves are disposed in piping upstream of the flare gas and motive fluid inlets on the ejectors, and that are selectively opened or closed to allow flow through the ejectors. The flowrate of the flare gas is monitored and distributed to a controller, which is programmed to calculate the required number of ejector legs to accommodate the amount of flare gas. The controller is also programmed to direct signals to actuators attached to the valves, which open or close the valves to change the capacity of the ejector legs so they can handle changing flowrates of the flare gas.

8 Claims, 3 Drawing Sheets

Related U.S. Application Data

(60) Provisional application No. 62/428,151, filed on Nov. 30, 2016.

(51) Int. Cl.
*F23G 5/50* (2006.01)
*F23N 1/00* (2006.01)

(52) U.S. Cl.
CPC ..... *F23N 1/002* (2013.01); *F23K 2400/20* (2020.05); *F23N 2241/12* (2020.01)

(56) References Cited

U.S. PATENT DOCUMENTS

| | | | | |
|---|---|---|---|---|
| 8,025,100 | B2 | 9/2011 | Dehaene et al. | |
| 8,100,671 | B2 | 1/2012 | Botros et al. | |
| 9,017,451 | B2 | 4/2015 | Wynn et al. | |
| 9,598,946 | B2 | 3/2017 | Shomody et al. | |
| 9,657,247 | B2 * | 5/2017 | Zink ..... | B01D 53/18 |
| 2012/0315587 | A1 | 12/2012 | Gross-Petersen | |
| 2015/0338097 | A1 | 11/2015 | Beg et al. | |
| 2016/0186276 | A1 | 6/2016 | Winter et al. | |
| 2016/0265322 | A1 | 9/2016 | Beg | |

* cited by examiner

DYNAMIC MULTI-LEGS EJECTOR FOR USE IN EMERGENCY FLARE GAS RECOVERY SYSTEM

CROSS-REFERENCE TO RELATED APPLICATION

This application is a continuation of and claims priority to and the benefit of co-pending U.S. patent application Ser. No. 15/810,668 filed Nov. 13, 2017; and which claimed priority from U.S. Provisional Application Ser. No. 62/428,151, filed Nov. 30, 2016, the full disclosures of which are incorporated by reference herein in their entireties and for all purposes.

BACKGROUND

1. Field

The present disclosure relates to a system and method for handling fluid directed to a flare system. More specifically, the present disclosure relates to a system and method for recovering fluid directed to a flare system for recycling back to a process facility.

2. Related Art

Flare disposal system are typically provided in facilities that handle or process volatile compounds, such as refineries and chemical plants. Flare disposal systems collect releases of compounds being handled in the facility, and channel the released compounds ("flare gas") through flare network piping. Flare disposal systems generally include flare headers, flare laterals, liquid knock-out drums, water seal drums, and one or more flare stacks. Flare headers are normally provided with continuous purging to prevent vacuums within the system, keep air out of the system, and prevent possible explosions. Usually the flare network piping delivers the compounds to the flare stack for combusting the compounds. During normal operations in the processing facility, the amount of flare gas collected ("normal flare gas flow") is primarily from gas used to purge the flare headers as well as gas leakage across isolation valves.

Excursions from normal operations in the facility (such as overpressure, automatic depressurizing during a fire, manual depressurizing during maintenance, the tripping of a compressor, off-spec gas products, downstream gas customer shut down, or extended field testing) generate an emergency flare gas flow, which has a flowrate that exceeds the normal flare gas flow. Some processing facilities include flare gas recovery systems, for diverting the normal gas flow back to the process facility, where the flare gas is sometimes pressurized and compressed so that it can be injected back into a process line, or to another destination through a pipeline. The gas is typically compressed by liquid-ring compressors, screw-type compressors, and blowers. Substantially all of the gas from a normal flare gas flow can be handled by most conventional flare gas recovery systems, thereby limiting flare operation to the excursions listed previously.

SUMMARY

Disclosed herein is an example of a method of handling a flow of flare gas that includes obtaining a flowrate of the flow of flare gas, directing the flow of the flare gas to a piping circuit comprising a plurality of ejector legs piped in parallel, comparing the flowrate of the flow of flare gas with flow capacities of the ejector legs, identifying a particular one or ones of the ejector legs having a cumulative capacity to adequately handle the flow of the flare gas, directing a flow of a motive gas to the piping circuit to motive gas inlets of ejectors in the particular one or ones of the ejector legs, and directing the flow of flare gas to suction inlets of the ejectors in the particular one or ones of the ejector legs. In one example, the flare gas and the motive gas combine in the ejectors to form a combination, which is then directed to a location in a processing facility. The method further optionally includes maintaining a pressure of the flare gas at the suction inlet at a substantially constant value and maintaining a pressure of the motive gas at the motive gas inlet at a substantially constant value. In one embodiment, each of the particular ejector legs have substantially the same flow capacities, and alternatively each of the particular ejector legs have different flow capacities. In an example, the method further includes repeating the step of comparing the flowrate of the flow of flare gas with flow capacities of the ejector legs at intervals separated by a time span. The flare gas can be produced by a particular depressurization scenario having a depressurization duration, and wherein the time span between subsequent steps of comparing the flowrate of the flow of flare gas with flow capacities of the ejector legs is approximately equal to the depressurization duration divided by the number of particular ejector legs into the depressurization duration. In an alternative, the ejector legs include a first set of ejector legs, the method further including repeating the steps obtaining a flowrate of the flare gas, directing the flare gas to a piping circuit, comparing the flare gas flow with ejector leg cumulative capacity, and identifying the legs having a cumulative capacity to adequately handle the flare gas flow, and then identifying a second set of ejector legs, and wherein the first set of ejector legs is different from the second set of ejector legs. The step of identifying a particular one or ones of the ejector legs optionally includes obtaining a quotient by dividing the flare gas flowrate by the capacities of the ejector legs, rounding the quotient to the nearest integer, and setting a quantity of the ejector legs equal to the nearest integer.

An alternate method of handling a flow of flare gas is described, and which includes obtaining a flowrate of the flare gas, directing the flare gas to a piping circuit comprising legs piped in parallel and an ejector in each leg, identifying which of the legs have a cumulative capacity to adequately handle the flare gas to define identified legs, routing the flare gas into the identified legs by bringing the identified legs online, obtaining an updated flowrate of the flare gas, confirming the identified legs have a cumulative capacity to adequately handle the flare gas with the updated flowrate, and changing a number of the identified legs if the cumulative capacity of the identified legs cannot adequately handle the flare gas at the updated flowrate. The method of this example optionally further includes determining an amount of motive gas to be provided to the ejectors. In an embodiment the method further includes providing a motive gas to the ejectors from a source in a processing facility. Alternatively, a combination of the flare gas and motive gas is discharged from the legs and directed to the processing facility. In an example, a capacity of each ejector is substantially equal to an anticipated minimum flowrate of the flare gas. Optionally, a total number of the legs is substantially equal to an anticipated maximum flowrate of the flare gas divided by the anticipated minimum flowrate of the flare gas. Also described is an example of a system for handling a flow of flare gas and which includes a piping circuit having legs of tubulars piped in parallel that are selectively online, an ejector in each of the legs and where a one of the ejectors has a design flowrate that is approximately equal to an anticipated minimum flowrate of the flare gas. In this example each ejector includes a low pressure inlet in selective communication with a source of the flare gas, a high pressure inlet in selective communication with a source of motive gas, and a mixing portion where flare gas and motive gas form a combination. A controller system is included in this example and that brings a quantity of the legs online that have a cumulative capacity that is at least as great as a measured flowrate of the flare gas. Alternatively a number of the legs of tubulars is approximately equal to an anticipated maximum flowrate of the flare gas divided by the design flowrate of the ejector. In one example all of the ejectors have the same design flowrate, or alternatively have different design flowrates.

BRIEF DESCRIPTION OF DRAWINGS

Some of the features and benefits of that in the present disclosure having been stated, others will become apparent as the description proceeds when taken in conjunction with the accompanying drawings, in which.

Figure 1:
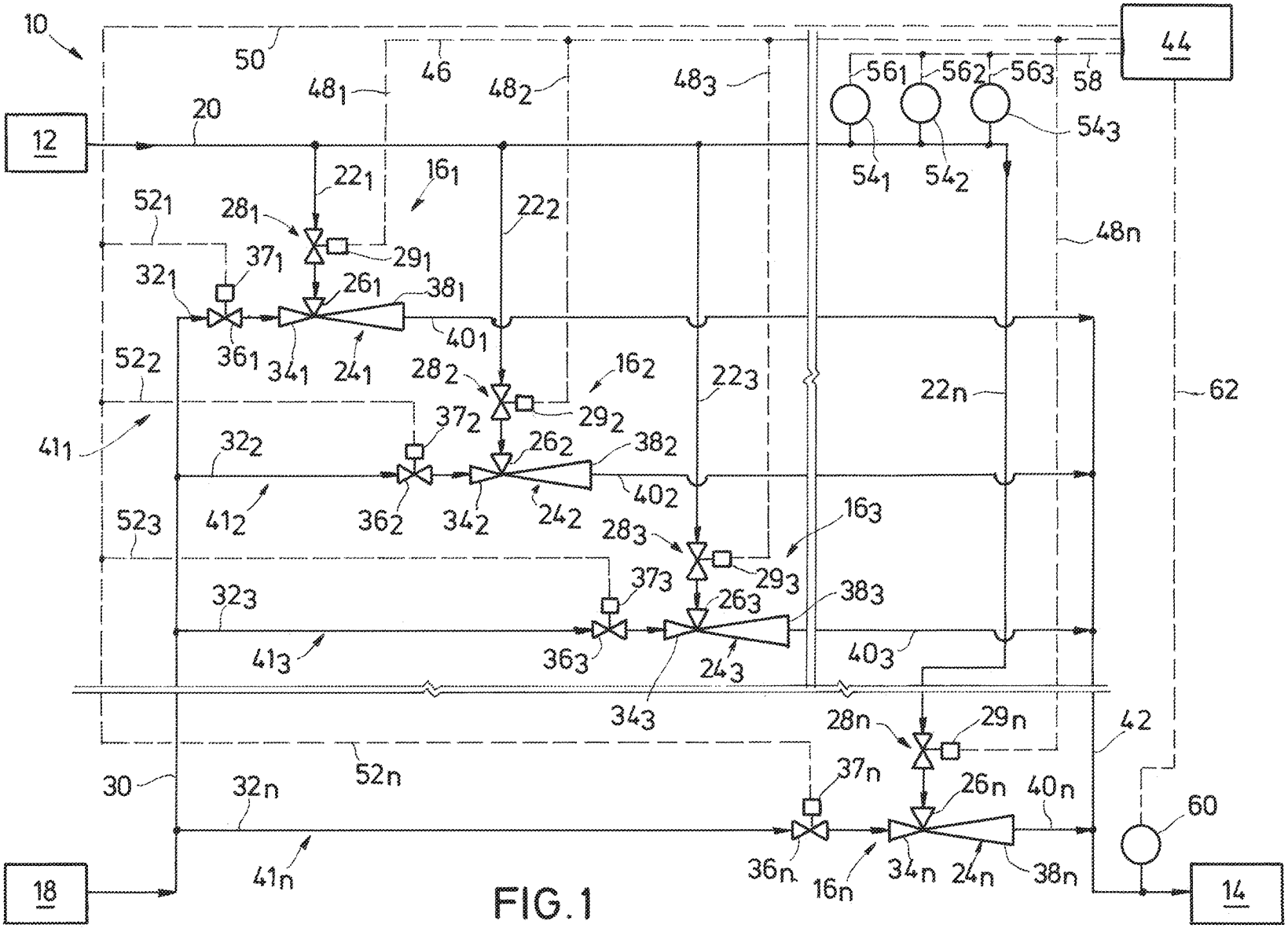
FIG. 1 is a schematic of an example of an emergency flare gas recovery system for use with a processing facility.

While that disclosed will be described in connection with the preferred embodiments, it will be understood that it is not intended to limit that embodiments. On the contrary, it is intended to cover all alternatives, modifications, and equivalents, as may be included within the spirit and scope of that described.

DETAILED DESCRIPTION

The method and system of the present disclosure will now be described more fully after with reference to the accompanying drawings in which embodiments are shown. The method and system of the present disclosure may be in many different forms and should not be construed as limited to the illustrated embodiments set forth; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Schematically illustrated in FIG. 1 is one example of an emergency flare gas recovery system 10 that receives flare gas from a flare gas supply 12 and pressurizes the flare gas for return back to a processing facility 14. In one embodiment the processing facility 14 includes a unit or system where volatile materials are being handled, such as a refinery or chemical plant. Also depicted in the example of FIG. 1 are "n" ejector systems $\mathbf{16}_1$, $\mathbf{16}_2$, $\mathbf{16}_3$ . . . $\mathbf{16}_n$, which in an alternative is represented as $\mathbf{16}_{1\text{-}n}$, and where n can be any integer. In the example, ejector systems $\mathbf{16}_{1\text{-}n}$ receive the flare gas from the flare gas supply 12; and a motive gas from a motive gas source 18 is also directed to the ejector systems $\mathbf{16}_{1\text{-}n}$ for providing a motive force for directing the flare gas to the processing facility 14. Embodiments exist where the combination of flare gas and motive gas are utilized in the processing facility 14, such as for a reactant, an additive, a fuel source, or inserted into a flow line (not shown) having the same or similar components as the combination. A schematic example of a flare gas header 20 is shown having one end in communication with the flare gas supply 12. Example flare gas inlet leads $\mathbf{22}_{1\text{-}n}$ extend from the flare gas header 20 and connect to ejectors $\mathbf{24}_{1\text{-}n}$. In the illustrated embodiment, flare gas inlets $\mathbf{26}_{1\text{-}n}$ are provided respectively on ejectors $\mathbf{24}_{1\text{-}n}$, and provide a connection point for the ends of the flare gas inlet leads $\mathbf{22}_{1\text{-}n}$. Further in the example of FIG. 1, flare gas inlet valves $\mathbf{28}_{1\text{-}n}$ are disposed respectively on the flare gas inlet leads $\mathbf{22}_{1\text{-}n}$ and which when opened and closed selectively block or allow flare gas flow to designated ones of the ejectors $\mathbf{24}_{1\text{-}n}$. Optional actuators $\mathbf{29}_{1\text{-}n}$ are shown coupled with valves $\mathbf{28}_{1\text{-}n}$, and when energized selectively open and/or close valves $\mathbf{28}_{1\text{-}n}$.

As illustrated in this example, motive gas header 30 connects to the motive gas source 18, and which provides fluid communication from the motive gas source 18 to motive gas inlet leads $\mathbf{32}_{1\text{-}n}$. The motive gas inlet leads $\mathbf{32}_{1\text{-}n}$ of this example extend from points along the motive gas header 30 and into connection with motive gas inlets $\mathbf{34}_{1\text{-}n}$ provided on ends of the ejectors $\mathbf{24}_{1\text{-}n}$. Included in the embodiment shown are motive gas inlet valves $\mathbf{36}_{1\text{-}n}$ that are set in line within the motive gas inlet leads $\mathbf{32}_{1\text{-}n}$, and like the flare gas inlet valves $\mathbf{28}_{1\text{-}n}$, are opened and closed to selectively block flow of motive gas to ones of the ejectors $\mathbf{24}_{1\text{-}n}$. Actuators $\mathbf{37}_{1\text{-}n}$ are included in this embodiment that mount to motive gas inlet valves $\mathbf{36}_{1\text{-}n}$, for opening and closing these valves $\mathbf{36}_{1\text{-}n}$.

In an example of operation, motive gas enters the ejectors $\mathbf{24}_{1\text{-}n}$ via motive gas inlets $\mathbf{34}_{1\text{-}n}$ and subsequently flows through reduced cross-sectional areas within ejectors $\mathbf{24}_{1\text{-}n}$ where velocities of the motive gas increase and its pressures reduce. In one embodiment, the ejectors $\mathbf{24}_{1\text{-}n}$ are strategically configured so that the pressures of the motive gas reduce within the reduced cross-sectional areas of ejectors $\mathbf{24}_{1\text{-}n}$ to below that of the flare gas at the flare gas inlets $\mathbf{26}_{1\text{-}n}$. Further in this embodiment, pressure differentials between the motive gas in the reduced cross-sectional areas of ejectors $\mathbf{24}_{1\text{-}n}$ and the flare gas at the flare gas inlets $\mathbf{26}_{1\text{-}n}$ draw the flare gas into gas ejectors $\mathbf{24}_{1\text{-}n}$ where it is combined with the motive gas. The cross-sectional areas of the flow paths within ejectors $\mathbf{24}_{1\text{-}n}$ in this example increase on sides of the reduced cross-sectional areas with distance away from the motive gas inlets $\mathbf{34}_{1\text{-}n}$, and which define ejector venturi $\mathbf{38}_{1\text{-}n}$. Inside the ejector venturi $\mathbf{38}_{1\text{-}n}$, velocities of the combinations of the motive and flare gas decrease, and pressures of the combinations increase. In the illustrated example, the motive gas and flare gas are mixed in the ejector venturi $\mathbf{38}_{1\text{-}n}$. In this example, discharge ends of the ejector venturi $\mathbf{38}_{1\text{-}n}$ are in fluid communication with discharge gas leads $\mathbf{40}_{1\text{-}n}$, so that the mixed fluid exiting the ejector venturi $\mathbf{38}_{1\text{-}n}$ is directed to the discharge gas leads $\mathbf{40}_{1\text{-}n}$.

Still referring to the example of FIG. 1, the combination of the leads $\mathbf{32}_{1\text{-}n}$, $\mathbf{40}_{1\text{-}n}$, valves $\mathbf{36}_{1\text{-}n}$, $\mathbf{28}_{1\text{-}n}$, and ejectors $\mathbf{24}_{1\text{-}n}$ define a series of ejector legs $\mathbf{41}_{1\text{-}n}$, which are shown piped in parallel. In a non-limiting example of operation, flare gas from the flare gas supply 12 and/or motive gas from the motive gas supply 18 are transmitted through specific ones of the legs $\mathbf{41}_{1-n}$ (i.e. brought online) by selectively opening/closing specific ones of the valves $\mathbf{36}_{1-n}$, $\mathbf{28}_{1-n}$, In the illustrated example, the discharge gas leads $\mathbf{40}_{1-n}$ distal from ejectors $\mathbf{24}_{1-n}$ terminate in a discharge gas header 42, which is depicted connecting to processing facility 14. In an example, ejector legs $\mathbf{41}_{1-n}$, flare gas header 20, and discharge gas header 42 define a piping circuit 43. In the example shown, the combination of flare and motive gas entering the discharge gas header 42 from the discharge gas leads $\mathbf{40}_{1-n}$ is transmitted to the processing facility 14.

Further schematically illustrated in the embodiment of FIG. 1 is a controller 44 that is in communication with the actuators $\mathbf{29}_{1-n}$ via a flare gas signal bus 46 and flare gas signal leads $\mathbf{48}_{1-n}$. Where signal leads $\mathbf{48}_{1-n}$ have ends distal from the flare gas signal bus 46 that connect to the actuators $\mathbf{29}_{1-n}$. Also shown connected to controller 44 in this embodiment is a motive gas signal bus 50, and motive gas signal leads $\mathbf{52}_{1-n}$ extending from motive gas signal bus 50 respectively to actuators $\mathbf{37}_{1-n}$. In an example, a designated flare gas leg or legs $\mathbf{41}_{1-n}$ is/are put online when a signal from controller 44 is directed to one or more of actuators $\mathbf{29}_{1-n}$, $\mathbf{37}_{1-n}$, that in turn open one or more of valves $\mathbf{28}_{1-n}$, $\mathbf{36}_{1-n}$ so that flare gas and motive gas flow to one or more of the ejectors $\mathbf{24}_{1-n}$. In a contrasting example, a designated flare gas leg or legs $\mathbf{41}_{1-n}$ is taken offline by controller 44 directing a signal(s) to actuators $\mathbf{29}_{1-n}$, $\mathbf{37}_{1-n}$, that in turn closes one or more of valves $\mathbf{28}_{1-n}$, $\mathbf{36}_{1-n}$ so that a flow of flare gas and motive gas is blocked to one or more of the ejectors $\mathbf{24}_{1-n}$. Optional flare gas indicators $\mathbf{54}_{1-3}$ are mounted on the flare gas header 20, and which selectively sense fluid flowrate, pressure, temperature, or other fluid properties or conditions within flare gas header 20. In an example, the data sensed by the flare gas indicators $\mathbf{54}_{1-3}$ is transmitted to controller 44 via flare gas indicator signal leads $\mathbf{56}_{1-3}$ and flare gas indicator signal line 58, which is shown as connecting the leads $\mathbf{56}_{1-3}$ to controller 44. A discharge gas indicator 60 is illustrated mounted onto discharge gas header 42 and also provides fluid property and condition information within header 42 and which is transmitted to controller 44 along discharge gas indicator signal line 62. In one example, controller 44 includes or is made up of an information handling system ("IHS"), where the IHS includes a processor, memory accessible by the processor, nonvolatile storage area accessible by the processor, and logics for performing steps described herein.

Figure 2:
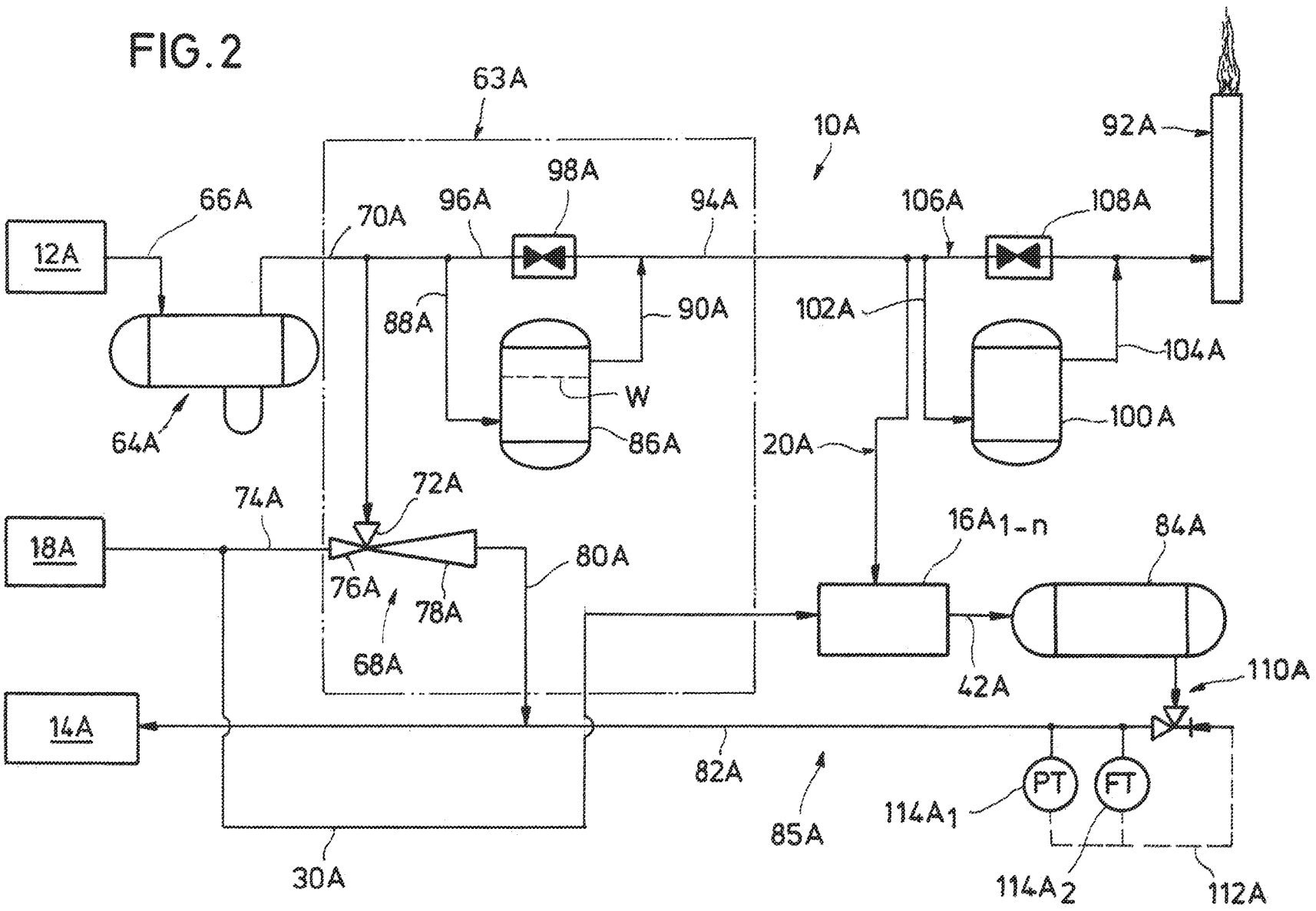
FIG. 2 is a schematic of an alternate example of the emergency flare gas recovery system of FIG. 1.

FIG. 2 shows in schematic form an alternate example of the emergency flare gas recovery system 10A, and which is combined with a conventional flare gas recovery system 63A. The embodiment of the conventional flare gas system 63A shown includes a knockout drum 64A, and knockout inlet line 66A that provides fluid communication from flare gas supply 12A to knockout drum 64A. Further in the example, an ejector 68A is shown downstream of knockout drum 64A, and a line 70A directs gas from knockout drum 64A to a flare gas inlet 72A. Here flare gas inlet 72A is attached to ejector 68A, so that flare gas is fed to ejector 68A via line 70A and flare gas inlet 72A. Motive gas source 18A is shown being in selective communication with ejector 68A via motive gas line 74A. An end of motive gas line 74A distal from motive gas header 30A connects to motive gas inlet 76A, that in turn is shown connected to ejector 68A. In the illustrated example opposing ends of the motive gas header 30A connect to the motive gas source 18A and the ejector system $\mathbf{16}\mathrm{A}_{1-n}$ respectively. Motive gas and flare gas are combined within ejector 68A, and as previously explained, pressure of the combined gases increases through the expanded cross-sectional area of the ejector venturi 78A while the velocity decreases.

Further in the example of FIG. 2, after exiting ejector venturi 78A the combined gases are piped into a discharge gas lead 80A and transferred to discharge gas line 82A. As shown, an end of discharge gas header 42A opposite from ejector systems $\mathbf{16}\mathrm{A}_{1-n}$ terminates in an optional flare gas storage tank 84A, where an end of discharge gas line 82A distal from processing facility 14A connects to flare gas storage tank 84A. In one example of operation, gas exiting ejector system $\mathbf{16}\mathrm{A}_{1-n}$ into discharge gas header 42A is delivered to and stored in flare gas storage 84A. In one example, discharge gas line 82A and flare gas storage 84A define a flare gas discharge 85A. Flare gas storage tank 84A and provides a way of delivering flare gas to the processing facility 14A at a consistent pressure.

Still referring to the example of FIG. 2, water seal drum 86A is shown having a volume of water W disposed within and in communication with flare gas in overhead line 70A via a seal drum inlet 88A. In instances where an amount of flare gas flowing within overhead line 70A exceeds the operating capacity of ejector 68A, the amount of flare gas exceeding the ejector 68A capacity is redirected into water seal drum 86A via seal drum inlet 88A. When the pressure of the flare gas within seal drum inlet 88A exceeds the static head of the water W above inlet 88A, the flare gas breaks the water seal and flows out of the water seal drum 86A via seal drum outlet 90A. As described in more detail below, a flare 92A is shown for optionally combusting the flare gas. In the illustrated embodiment, flare gas exiting seal drum outlet 90A is directed into flare header 94A. An optional bypass 96A is shown connected between lines 70A, 94A thereby circumventing water seal drum 86A. In a non-limiting example of use, the bypass 96A provides for an alternate route of gas flow should the water seal in the drum 86A fail to break. A block valve 98A in illustrated that is disposed in bypass 96A, and which are selectively opened and closed to allow flow through bypass 96A and between lines 70A, 94A. In one alternative, a rupture pin or bursting disc is used in place of block valve 98A.

A water seal drum 100A is illustrated in this example of FIG. 2 and disposed downstream of water seal drum 86A, water seal drum 100A is in fluid communication with flare header 94A via seal drum inlet line 102A. Similar to water seal drum 86A, an amount of water (not shown) in water seal drum 100A forms a low pressure barrier blocking flare gas within header 94A from reaching flare stack 92A until pressure of flare gas exceeds that of the low pressure barrier. Once the seal within seal drum 100A is broken, the flare gas makes its way to flare stack 92A via seal drum outlet line 104A. An optional bypass 106A is provided with this example and which includes a block valve 108A, that when selectively opened provides a bypass around water seal drum 100A. Optionally, a rupture pin or bursting disc is used in place of the block valve 108A. Upon reaching the flare stack 92A, flare gas is combusted and with its combustion products being distributed into the atmosphere from flare stack 92A. Flare gas header 20A connects to flare header 94A upstream of seal drum inlet line 102A and provides flare gas to ejector system $\mathbf{16}\mathrm{A}_{1-n}$.

Still referring to FIG. 2, a control valve 110A is shown provided within discharge gas line 82A, and that in one example is a pressure control valve that selectively opens when pressure within the storage tank 84A is at or exceeds a designated value. Thus, the control valve 110A in this example operates to ensure that the pressure of the discharge gas within discharge header 82A is sufficient to be reinjected back into the process facility 14A. Further, optionally, a feedback circuit 112A is shown that provides data sensed from indicators 114$A_{1,2}$ and back to control valve 110A. In an example, the sensors 114$A_{1,2}$ are equipped to sense one or more of pressure, flow, and/or temperature in discharge gas line 82A and provide signal data back to control valve 110A representative of the pressure, flow, and/or temperature. In an alternative, a logic circuit (not shown) receives the signal data and operates per a rule based system to selectively open and close control valve 110A.

Example scenarios of flare gas releases to a flare system include pressure safety relieving, automatic blow-down (depressurizing), manual depressurization (such as venting during maintenance). Transient flow-rates associated with the pressure safety relieving scenario can occur when equipment or piping systems are over pressured and reach a relief valve or rupture disc set point that was installed to protect equipment or piping. Flowrates for this scenario can be considered to be continuous when relieving due to a blocked discharge. In an example a pressure safety relieving instance has a limited duration of time of about maximum 10-15 minutes as the relieving rate ceases once the source of overpressure is isolated or eliminated.

In one example, automatic blow-down (depressurizing) occurs due to process plant safety requirements. Here, each pressurized system is to be protected against the possibility of rupture under fire conditions by providing automatic isolation valves at key system boundaries and a blow-down valve for each system/segment of the entire plant based on the fire isolation philosophy of the plant. In the event of fire in a particular segment of the processing facility 14, the isolation valves (not shown) will automatically closed while the blow-down valve (not shown) will automatically opened and each system will be depressurized to a specific limit within a given time. API RP 521 ($6^{th}$ edition, 2014) recommends depressurizing to 6.9 bar gauge or 50% of (vessel) design pressure, whichever is the lower, within 15 minutes. This is achievable by using a control valve or alternatively by using a combination of automated isolation valve (blow-down valve) with fixed orifice downstream. In one embodiment, the blow-down valve opens fully automatically on demand. Compressors are optionally blown-down automatically on shutdown to protect the machine from surging damage or to prevent gas escape through the compressor seals.

An example step of manual depressurization/venting for maintenance occurs to shutdown, isolate, or take a particular segment of a process plant out of service for maintenance purposes. An example of this procedure requires venting out all the gas inventories of the system to the flare. In this example, operators open a manual isolation valve to depressurize the content of the system until minimum pressure possible is attained. Subsequently, the inventory remaining is removed using higher pressure nitrogen or steam as purge gas.

Figure 3:
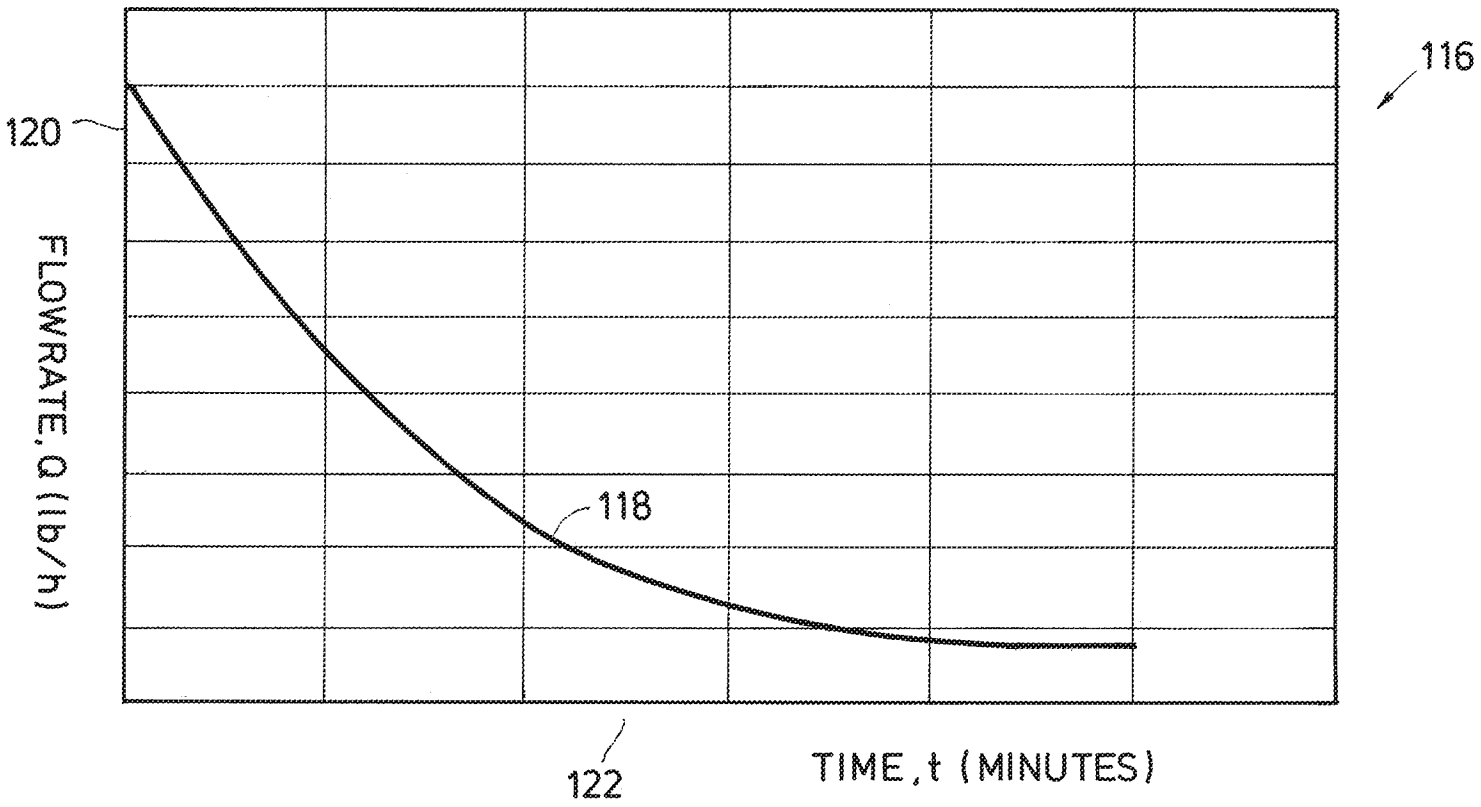
FIG. 3 is a graphical depiction of an example of a flowrate of emergency flare gas over time.

An example of how flowrate of flare gas release varies over time is depicted in graphical form in FIG. 3. A graph 116 is illustrated in FIG. 3 which includes a line 118 whose configuration approximates an exponential function. An ordinate 120 of graph 116 represents a flowrate of flare gas flowing to emergency flare gas recovery system 10, and the abscissa 122 represents a corresponding time at which the flowrates occur. Line 118 of FIG. 3 thus represents a flare gas flowrate over time; where the flowrate is an example of a relieving scenario of flare gas flowing to the emergency flare gas recovery system 10 (FIG. 1). Line 118 on graph 116 exponentially reduces over time from a $Q_{max}$ to a $Q_{min}$ to reflect how the flowrate significantly reduces with time. Also over time, line 118 approaches an asymptote 124 shown extending substantially parallel with abscissa 122.

In one example of designing the emergency flare gas recovery system 10 of FIG. 1, transient emergency flaring events are identified, and a corresponding flowrate of flare gas versus time, such as that illustrated in FIG. 3, is generated for each of the identified events. Examples of transient relieving events are described above (that is, pressure safety relieving, automatic blowdown, and manual depressurization). In one example, the flaring events identified are those deemed reasonably possible by operations personnel familiar with the facility (or similar facilities) experiencing the flaring event. Graphs (not shown) having flare gas flowrates (similar to graph 116) representing the identified transient depressurization scenarios are generated, and the event having the lowest flowrate is noted. In one embodiment the lowest flowrate is the flowrate observed when approaching the asymptote of the graph (see, FIG. 3). The pressure of the motive gas source 18 is identified so that an ejector with an adequate capacity is selected. In one alternative, the motive gas source 18 selected is that having the greatest pressure and with abundant storage that can guarantee steady supply at the same pressure. Examples of the motive gas source 18 include high-pressure oil/gas reservoir or a major pipeline supply such as sales gas grid pipeline. Further optionally, the motive gas source 18 is disposed in the processing facility 14. In examples where the flare gas pressure is set by the water seal in water seal drum 100A (FIG. 2), a pressure ratio of high-pressure motive stream to the low-pressure suction pressure is equal to absolute values of the greatest pressure source over the pressure required to break the water seal in seal drum 100A. The maximum pressure of the gas being discharged from the ejectors is then identified, which in one embodiment depends on a terminal pressure of the discharge gas stream. In examples where maximum ejector discharge pressure is limited by ejector design to be a factor of the low pressure fluid, which in the illustrated example is flare gas, ejectors are placed in series (not shown) to achieve the designated discharge pressure. The maximum pressure can depend on a number of factors but it is considered to be well within the capabilities of those skilled in the art to identify this pressure. In one embodiment, knowing the amount of flare gas to be handled, a calculation for the necessary flowrate of the high pressure motive gas is obtained either through a computer simulation, or from charts available from a manufacturer or vendor of a selected ejector. These steps are believed to be well within the capabilities of those skilled in the art, the results of which can be obtained without undue experimentation.

A further example step of designing the emergency flare gas recovery system 10, the anticipated maximum and minimum flare gas flowrates $Q_{max}$, $Q_{min}$ are identified. In this example, the anticipated maximum flare gas flowrate $Q_{max}$ is highest flowrate estimated from the identified relieving scenarios, and the anticipated minimum flare gas flowrate $Q_{min}$ is the lowest flowrate estimated from the identified relieving scenarios. Thus the maximum and minimum flare gas flowrates $Q_{max}$, $Q_{min}$ in this example are not necessarily that which are anticipated to occur in the same relieving scenario, but examples exist where the flowrates $Q_{max}$, $Q_{min}$ are taken from different relieving scenarios. For the purposes of discussion herein, the maximum flare gas flowrate $Q_{max}$ is referred to as a maximum anticipated flowrate of flare gas, and the minimum flare gas flowrate $Q_{min}$ is referred to as a minimum anticipated flowrate of flare gas. Further in this example, a ratio is obtained by dividing the value of the maximum flare gas flowrate $Q_{max}$ by the value of the minimum flare gas flowrate $Q_{min}$ The value of the ratio in this example is used to set a quantity of ejector legs $\mathbf{41}_{1\text{-}n}$ that are to be installed in the emergency flare gas recovery system 10. In this example, the number of ejector legs $\mathbf{41}_{1\text{-}n}$ that are to be installed have a cumulative capacity to be able to adequately handle flare gas at a flowrate that is at least as large as the maximum flare gas flowrate $Q_{max}$. Further in this example, each of the ejector legs $\mathbf{41}_{1\text{-}n}$ to be installed has a capacity to be able to adequately handle flare gas at a flowrate that is at least as large as, or is equal to minimum flare gas flowrate $Q_{min}$. In an alternative, ejectors $\mathbf{24}_{1\text{-}n}$ in the ejector legs $\mathbf{41}_{1\text{-}n}$ are sized based on a minimum capacity of flow to be at least that of minimum flare gas flowrate $Q_{min}$, with suction gas pressure equal to the release pressure of the water seal drum 100A, and a discharge pressure at around that of header 42, 42A. Sizing of the ejectors to have a particular design flow (which in this embodiment is the minimum flare gas flowrate $Q_{min}$), is well within the capabilities of those skilled in the art. Embodiments exist where capacities of each of the ejectors $\mathbf{24}_{1\text{-}n}$ are substantially the same, or where the capacities of the individual ejectors $\mathbf{24}_{1\text{-}n}$ vary. Installing ejectors $\mathbf{24}_{1\text{-}n}$ of different capacities provides the emergency flare gas recovery system 10 with flexibility to be configured into numerous discrete capacities and adequately handle a wide range of flowrates of flare gas. For example, if a minimum flow is at around 20,000 pounds an hour, but other sustained expected flows exceed the minimum flow by less than 20,000, the scenario includes installing an ejector having a capacitor of around 20,000 and additional ejectors having capacities of something less than 20,000 pounds an hour.

In a non-limiting example of operation, information about the flare gas, such as flowrate, properties, and conditions, is received by the controller 44 (FIG. 1), where logics in the controller 44 calculate a capacity of the emergency flare gas recovery system 10 required to adequately handle the flare gas ("required capacity"). Information about capacities of each of the ejectors $\mathbf{24}_{1\text{-}n}$, and thus each of the ejector legs $\mathbf{41}_{1\text{-}n}$, is accessible by the controller 44. Embodiments exist where the capacity information accessible by the controller 44 is stored on the controller 44, stored remote from the controller 44 and accessed via a connection (either hardwired or wireless), or provided in response to a query from the controller 44. Alternatively, controller 44 receives information about the flare gas from the flare gas indicators $\mathbf{54}_{1\text{-}3}$, where the information sensed by flare gas indicators $\mathbf{54}_{1\text{-}3}$ is converted into useable data and transmitted to controller 44.

In an example step, controller 44 determines which of the ejector legs $\mathbf{41}_{1\text{-}n}$ to put online based upon the received signal data representing the information from within flare gas header 20. The determination by the controller 44 identifies the ejector legs $\mathbf{41}_{1\text{-}n}$ so the emergency flare gas recovery system 10 adequately handles flare gas in the flare gas header 20. One example of adequately handling flare gas in the flare gas header 20 includes directing flare gas received from the flare gas header 20 through the ejector legs $\mathbf{41}_{1\text{-}n}$ at substantially the flowrate of flare gas flowing from the flare gas header 20. In this example, adequately handling the flare gas includes directing the flare gas into the discharge gas header 42 at a pressure sufficient for entry into the processing facility 14. Thus in this example pressure losses in the system 10 of the flare gas are suppressed so the flare gas is at least at the sufficient pressure. Further in this example, controller 44 is configured to identify the flow of flare gas and divert the amount of flare gas to one or more ejector legs $\mathbf{41}_{1\text{-}n}$ whose cumulative capacities correspond to (i.e. are substantially similar in magnitude) the flowrate of the flare gas flowing in flare gas header 20. Thus in an example, the flare gas in the flare gas header 20 is adequately handled when the cumulative capacity or capacities of the leg or legs $\mathbf{41}_{1\text{-}n}$ corresponds to the flowrate of the flare gas.

In situations where the capacities of the ejectors $\mathbf{24}_{1\text{-}n}$ have the same individual capacity, the required capacity is divided by the individual capacity to obtain a quotient, and the number of ejector legs $\mathbf{41}_{1\text{-}n}$ put online is equal to the quotient. Alternatively, the quotient is rounded to the nearest integer, and the number of ejector legs $\mathbf{41}_{1\text{-}n}$ put online is equal to that integer. In an optional example, pressure at inlets $\mathbf{26}_1$, $\mathbf{34}_{1\text{-}n}$ is maintained substantially constant, such as by manipulation of valves $\mathbf{28}_1$, $\mathbf{36}_{1\text{-}n}$. Further optionally, valve $\mathbf{36}_{1\text{-}n}$ is selectively controlled to adjust pressure and/or flowrate of motive gas to ejectors $\mathbf{24}_{1\text{-}n}$ to accommodate for any changes in the terminal pressure of discharge gas header 42.

In an alternative example of operation, the particular ejector legs $\mathbf{41}_{1\text{-}n}$ put online have ejectors $\mathbf{24}_{1\text{-}n}$ of different capacities, but because ejector $\mathbf{24}_{1\text{-}n}$ capacity information is accessibly by the controller 44, the cumulative capacities are of sufficient magnitude so that the ejector legs $\mathbf{41}_{1\text{-}n}$ put online adequately handle the flow of flare gas. An alternative to this example exists where the calculation to determine the number of ejector legs $\mathbf{41}_{1\text{-}n}$ to put online considers multiple combinations of ejector legs $\mathbf{41}_{1\text{-}n}$ having different capacities, and selects the scenario having a minimum number of ejector legs $\mathbf{41}_{1\text{-}n}$ that are online. In this alternative, a scenario of one leg having a larger capacity in conjunction with two legs of smaller capacity would be selected over a scenario of four legs of smaller capacity.

Further, it should be pointed out that the motive gas valves $\mathbf{36}_{1\text{-}n}$ in one example act as control valves whose cross-sectional areas are adjusted incrementally to vary the flow of motive gas to the ejectors $\mathbf{24}_{1\text{-}n}$ to selected designated values so that operation of the ejectors $\mathbf{24}_{1\text{-}n}$ is in accordance with the design. In an alternative, the difference in time between subsequent process calculations is approximately the time for the longest depressurization scenario divided by the number of ejector legs $\mathbf{41}_{1\text{-}n}$. Thus, in this example if the longest depressurization scenario has a duration of 16 minutes, and 8 ejector legs $\mathbf{41}_{1\text{-}n}$ are online, then a time span between subsequent calculations will be about every 2 minutes. In this example, the controller 44 reassesses the flow of the flare gas and compares that flow to the capacity of the emergency flare gas recovery system 10 to adequately handle the flare gas flow. Further in this example, if changes in flare gas flow are detected, the controller 44 recalculates the capacity required to adequately handle the new flow, identifies ejector legs $\mathbf{41}_{1\text{-}n}$ having the required capacity, and sends instructions to open valves $\mathbf{28}_{1\text{-}n}$, $\mathbf{36}_{1\text{-}n}$ so that the identified ejector legs $\mathbf{41}_{1\text{-}n}$ are put online. Thus alternatives exist where the system and method described herein reacts in real time to changing conditions of flare gas flow to continuously handle the flow of flare gas over changing conditions.

The present disclosure, therefore, is well adapted to carry out the objects and attain the ends and advantages mentioned, as well as others inherent. While a presently preferred embodiment of the disclosure has been given for purposes of disclosure, numerous changes exist in the details of procedures for accomplishing the desired results. In one embodiment, the vessels, valves, and associated instrumentation are all mounted onto a single skid unit. Optionally, screw type compressors are used in conjunction with or in place of the ejectors. These and other similar modifications will readily suggest themselves to those skilled in the art, and are intended to be encompassed within the spirit of the present disclosure and the scope of the appended claims.

What is claimed is:

1. A system for handling a flow of flare gas comprising:

a piping circuit comprising legs of tubulars piped in parallel that are selectively online;

an ejector in each of the legs and where a one of the ejectors has a design flowrate that is approximately equal to an anticipated minimum flowrate of the flare gas, each ejector comprising, a low pressure inlet in selective communication with a source of the flare gas, a high pressure inlet in selective communication with a source of motive gas, and a mixing portion where flare gas and motive gas form a combination;

a controller system for bringing a quantity of the legs online that have a cumulative capacity that is at least as great as a measured flowrate of the flare gas, and maintains a pressure of the motive gas at the motive gas inlet at a substantially constant value; and a discharge gas header having an end coupled with a processing facility, and that selectively receives a flow of the combination.

2. The system of claim 1, wherein a number of the legs of tubulars is approximately equal to an anticipated maximum flowrate of the flare gas divided by the design flowrate of the ejectors.

3. The system of claim 1, wherein all of the ejectors have the same design flowrate.

4. The system of claim 1, wherein some of the ejectors have different design flowrates.

5. The system of claim 1, wherein a total number of the legs is substantially equal to an anticipated maximum flowrate of the flare gas divided by the anticipated minimum flowrate of the flare gas.

6. The system of claim 1, wherein a pressure of the flare gas at the lower pressure inlet is at a substantially constant value.

7. The system of claim 1, wherein a pressure of the motive gas at the high pressure inlet is at a substantially constant value.

8. The system of claim 1, further comprising a flare header that selectively receives a portion of the flow of the flare gas from the flare gas supply, and directs the portion to a flare.

* * * * *